US011227548B2

(12) United States Patent
Xuan

(10) Patent No.: US 11,227,548 B2
(45) Date of Patent: Jan. 18, 2022

(54) PIXEL CIRCUIT AND DISPLAY DEVICE

(71) Applicant: BOE TECHNOLOGY GROUP CO., LTD., Beijing (CN)

(72) Inventor: Minghua Xuan, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/949,209

(22) Filed: Oct. 20, 2020

(65) Prior Publication Data

US 2021/0158757 A1 May 27, 2021

(30) Foreign Application Priority Data

Nov. 27, 2019 (CN) ..... 201922088205.0

(51) Int. Cl.
*G09G 3/3258* (2016.01)
*G09G 3/3291* (2016.01)
*G09G 3/3233* (2016.01)

(52) U.S. Cl.
CPC ..... *G09G 3/3258* (2013.01); *G09G 3/3291* (2013.01); *G09G 3/3233* (2013.01)

(58) Field of Classification Search
CPC .. G09G 3/3233; G09G 3/3258; G09G 3/3291; G09G 2300/0809; G09G 2300/0876
USPC ..... 345/176, 76
See application file for complete search history.

(56) References Cited

U.S. PATENT DOCUMENTS 8,264,428 B2 * 9/2012 Nam ..... G09G 3/3233 345/76
9,786,222 B2 * 10/2017 Lim ..... G09G 3/3233
2005/0041002 A1 * 2/2005 Takahara ..... H01L 27/1251 345/76
2006/0256058 A1 * 11/2006 Asano ..... G09G 3/3233 345/92
2006/0267884 A1 * 11/2006 Takahashi ..... G09G 3/3233 345/76
2011/0084993 A1 * 4/2011 Kawabe ..... G09G 3/3233 345/691
2012/0038617 A1 * 2/2012 Chung ..... H04N 13/341 345/212
2012/0293479 A1 * 11/2012 Han ..... G09G 3/3266 345/212
2014/0192037 A1 * 7/2014 Chung ..... G09G 3/2022 345/212
2016/0049117 A1 * 2/2016 Mitomi ..... G09G 3/3233 345/214

(Continued)

*Primary Examiner* — Tom V Sheng
(74) *Attorney, Agent, or Firm* — Brooks Kushman P.C.

(57) ABSTRACT

A pixel circuit and a display device are provided. The pixel circuit includes: a data writing circuit, a storage capacitor circuit, a driving circuit, a light-emitting duration control circuit, and a light-emitting device, where the data writing circuit is configured to, in response to a gate driving signal, write a display data voltage on a display data line to a control end of the driving circuit; a first end of the storage capacitor circuit is electrically connected to a control end of the driving circuit; the light-emitting duration control circuit is configured to, in response to a duration data voltage provided by a duration data line, turn on or turn off an electrical connection between the second end of the driving circuit and the light-emitting device, to control a light-emitting duration of the light-emitting device.

15 Claims, 6 Drawing Sheets

(56) References Cited

U.S. PATENT DOCUMENTS

| | | | | |
|---|---|---|---|---|
| 2016/0218155 | A1* | 7/2016 | Park | H01L 27/3262 |
| 2017/0004764 | A1* | 1/2017 | Kim | G09G 3/3233 |
| 2017/0061877 | A1* | 3/2017 | Lee | H01L 27/3262 |
| 2017/0076671 | A1* | 3/2017 | Kim | G09G 3/3266 |
| 2017/0132980 | A1* | 5/2017 | Wu | G09G 3/3233 |
| 2017/0193919 | A1* | 7/2017 | Hwang | G09G 3/3233 |
| 2018/0308412 | A1* | 10/2018 | Wu | H01L 27/3262 |
| 2020/0202782 | A1* | 6/2020 | Huangfu | G09G 3/3266 |
| 2020/0279524 | A1* | 9/2020 | Zhang | G09G 3/3233 |
| 2020/0365074 | A1* | 11/2020 | Hashimoto | G09G 3/3233 |

* cited by examiner

PIXEL CIRCUIT AND DISPLAY DEVICE

CROSS REFERENCE OF RELATED APPLICATION

This application claims priority to Chinese Patent Application No. 201922088205.0 filed on Nov. 27, 2019, which is incorporated herein by reference in its entirety.

TECHNICAL FIELD

The present disclosure relates to the field of display technologies, and in particularly to a pixel circuit and a display device.

BACKGROUND

An Organic Light-Emitting Diode (OLED) micro display is at the intersection of a microelectronic technology and an optoelectronic technology, combines an OLED technology and a Complementary Metal Oxide Semiconductor (CMOS) technology, which is a cross-integration of the optoelectronic industry and the microelectronic industry, promotes the development of a new generation of micro display, and promotes the research and development of organic electrons on silicon, even molecular electrons on silicon.

In the related silicon-based OLED display device, when the Pixels Per Inch (PPI) is high, the pixel driving circuit generally adopts a voltage driving mode, however, when the display device is in a high-brightness mode, a low-gray-scale display cannot be realized.

SUMMARY

In a first aspect, a pixel circuit is provided in the present disclosure, including a data writing circuit, a storage capacitor circuit, a driving circuit, a light-emitting duration control circuit, and a light-emitting device, where the data writing circuit is configured to, in response to a gate driving signal provided by a gate line, write a display data voltage on a display data line to a control end of the driving circuit;

a first end of the storage capacitor circuit is electrically connected to a control end of the driving circuit, and a second end of the storage capacitor circuit is electrically connected to a first voltage end;

a first end of the driving circuit is electrically connected to a power supply voltage line, a second end of the driving circuit is electrically connected to the light-emitting device via the light emitting duration control circuit, and the driving circuit is configured to, in response to a potential of a control end of the driving circuit, enable the first end of the driving circuit to electrically connect to the second end of the driving circuit;

the light-emitting duration control circuit is configured to, in response to a duration data voltage provided by a duration data line, turn on or turn off an electrical connection between the second end of the driving circuit and the light-emitting device, to control a light-emitting duration of the light-emitting device.

Optionally, the light-emitting duration control circuit includes a switch control circuit, a duration data voltage writing circuit and a holding capacitor circuit, where the duration data voltage writing circuit is configured to, in response to a duration control signal provided by a duration control line, write the duration data voltage provided by the duration data line to a first end of the holding capacitor circuit;

the first end of the holding capacitor circuit is electrically connected to a control end of the switch control circuit, and a second end of the holding capacitor circuit is electrically connected to a second voltage end;

the switch control circuit is configured to, in response to a potential of the first end of the holding capacitor circuit, turn on or turn off the electrical connection between the second end of the driving circuit and the light-emitting device.

Optionally, the duration data voltage writing circuit includes a duration data voltage writing transistor;

a control electrode of the duration data voltage writing transistor is electrically connected to the duration control line, a first electrode of the duration data voltage writing transistor is electrically connected to the duration data line, and a second electrode of the duration data voltage writing transistor is electrically connected to the first end of the holding capacitor circuit.

Optionally, the holding capacitor circuit includes a capacitor, a first end of the capacitor is electrically connected to the control end of the switch control circuit, and a second end of the capacitor is electrically connected to the second voltage end.

Optionally, the switch control circuit includes a switch transistor;

a control electrode of the switch transistor is electrically connected to the first end of the holding capacitor circuit, a first electrode of the switch transistor is electrically connected to the second end of the driving circuit, and a second electrode of the switch transistor is electrically connected to the light-emitting device.

Optionally, the pixel circuit further includes a light-emitting control circuit, where the first end of the driving circuit is electrically connected to the power supply voltage line via the light-emitting control circuit, and the light-emitting control circuit is configured to, in response to a light-emitting control signal provided by a light-emitting control line, enable the first end of the driving circuit to electrically connect to the power supply voltage line.

Optionally, the driving circuit includes a driving transistor, a control electrode of the driving transistor is connected to the first end of the storage capacitor circuit, a first electrode of the driving transistor is connected to a second end of the light-emitting control circuit, and a second electrode of the driving transistor is connected to a first end of the light-emitting duration control circuit.

Optionally, the gate line includes a first gate line and a second gate line;

the data writing circuit includes a first data writing transistor and a second data writing transistor;

a gate of the first data writing transistor is connected to the first gate line, a source of the first data writing transistor is connected to the data line, and a drain of the first data writing transistor is connected to the first end of the storage capacitor circuit;

a gate of the second data writing transistor is connected to the second gate line, a drain of the second data writing transistor is connected to the data line, and a source of the second data writing transistor is connected to the first end of the storage capacitor circuit;

the first data writing transistor is a type-P transistor, and the second data writing transistor is a type-N transistor.

Optionally, the light-emitting device is an organic light-emitting device.

Optionally, the holding capacitor circuit is configured to hold the potential of the first end of the holding capacitor circuit to be equal to a potential of the duration data voltage in a case that the duration data voltage writing circuit writes the duration data voltage to the first end of the holding capacitor circuit.

Optionally, the switch transistor is an NMOS transistor.

Optionally, the duration data voltage writing transistor is an NMOS transistor.

Optionally, the light-emitting control circuit includes a light-emitting control transistor, where a control electrode of the light-emitting control transistor is electrically connected to the light-emitting control line, a first electrode of the light-emitting control transistor is connected to the power supply voltage line, and a second electrode of the light-emitting control transistor is connected to the first electrode of the driving transistor.

Optionally, the light-emitting control transistor is a PMOS transistor.

A display device including the pixel circuit hereinabove is further provided in the present disclosure.

BRIEF DESCRIPTION OF THE DRAWINGS

The drawings described herein are configured to provide a further understanding of the present disclosure and constitute a part of the present disclosure. The embodiments of the present disclosure and the descriptions are used to explain the present disclosure and do not constitute an undue limitation on the present disclosure.

DETAILED DESCRIPTION

The technical solution in some embodiments of the present disclosure will be described more clearly and completely below in conjunction with the accompanying drawings of some embodiments of the present disclosure, and it will be apparent that the described embodiments are some, but not all, embodiments of the present disclosure. Based on the embodiments in the present disclosure, all other embodiments obtained by a person of ordinary skill in the art without involving any inventive effort are within the scope of the present disclosure.

The transistors employed in all embodiments of the present disclosure may be transistors, thin film transistors, or field effect transistors or other devices having the same characteristics. In some embodiments of the present disclosure, to distinguish two electrodes of a transistor other than a control electrode, one of the two electrodes is referred to as a first electrode and the other of the two electrodes is referred to as a second electrode, and a transmission direction of a signal in the transistor is from the first electrode of the transistor to the second electrode of the transistor.

In an actual operation, when the transistor is a triode, the control electrode may be a base electrode, the first electrode may be a collector electrode, and the second electrode may be an emitter electrode; alternatively, the control electrode may be a base electrode, the first electrode may be an emitter electrode, and the second electrode may be a collector electrode.

In an actual operation, when the transistor is a thin film transistor or a field effect transistor, the control electrode may be a gate electrode, the first electrode may be a drain electrode, and the second electrode may be a source electrode; alternatively, the control electrode may be a gate electrode, the first electrode may be a source electrode, and the second electrode may be a drain electrode.

Figure 1:
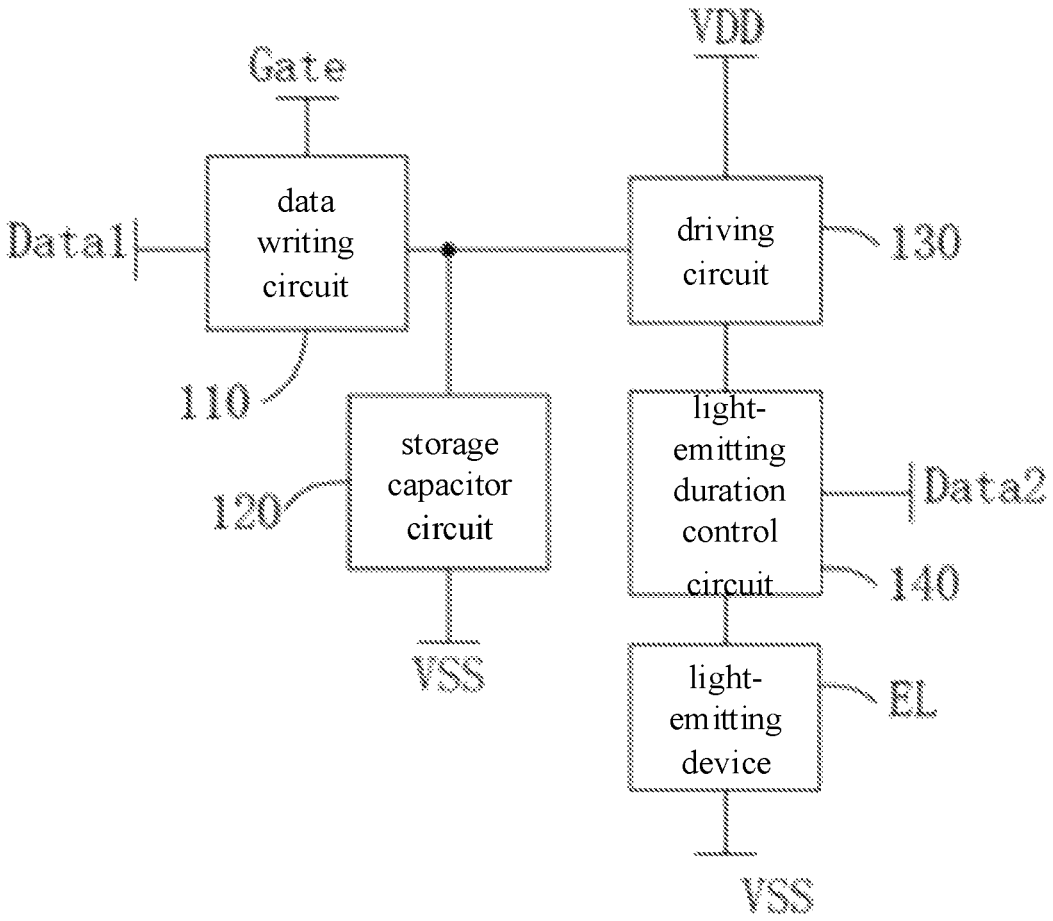
FIG. 1 is a schematic structural diagram of a pixel circuit in some embodiments of the present disclosure.

As shown in FIG. 1, a pixel circuit is provided in some embodiments of the present disclosure, including a data writing circuit 110, a storage capacitor circuit 120, a driving circuit 130, a light-emitting duration control circuit 140, and a light-emitting device EL.

The data writing circuit 110 is configured to write a display data voltage on the display data line Data1 to a control end of the driving circuit 130 in response to a gate driving signal provided by the gate line Gate.

A first end of the storage capacitor circuit 120 is electrically connected to a control end of the driving circuit 130, and a second end of the storage capacitor circuit 120 is electrically connected to a first voltage end.

A first end of the driving circuit 130 is electrically connected to the power supply voltage line VDD, a second end of the driving circuit 130 is electrically connected to the light-emitting device via the light-emitting duration control circuit 140, and the driving circuit 130 is configured to, in response to a potential of a control end thereof, enable the first end of the driving circuit 130 to electrically connect to the second end of the driving circuit 130.

The light-emitting duration control circuit 140 is configured to, in response to the duration data voltage provided by the duration data line Data2, turn on or turn off an electrical connection between the second end of the driving circuit 130 and the light-emitting device, to control a light-emitting duration of the light-emitting device.

According to the embodiments of the present disclosure, under the control of the duration data voltage provided by the duration data line, the light-emitting duration control circuit turns on or turns off the electrical connection between the second end of the driving circuit and the light-emitting device, to control the light-emitting duration of the light-emitting device. In this way, in the high-brightness mode, by reducing the light-emitting duration of the light-emitting device, the display brightness perceived by the human eye may be reduced even if the human eye perceives the low-gray-scale display, thereby realizing the low-gray-scale display of the display device in the high-brightness mode, and improving the display quality of the display device.

The plurality of gate lines and the plurality of display data lines are interleaved to form a plurality of pixel regions, and the pixel circuit is located in each of the pixel regions to drive the light-emitting device EL to emit light in response to the gate driving signal and the display data voltage, so as to realize the display of the display device.

As shown in FIG. 1, the control end of the data writing circuit 110 is connected to the gate line, the first end of the data writing circuit 110 is connected to the display data line, and the second end of the data writing circuit 110 is connected to the control end of the driving circuit 130. In response to the gate driving signal provided by the gate line, the first end of the data writing circuit 110 is electrically connected to the second end of the data writing circuit 110, thereby writing the display data voltage on the display data line to the control end of the driving circuit 130.

Figure 2:
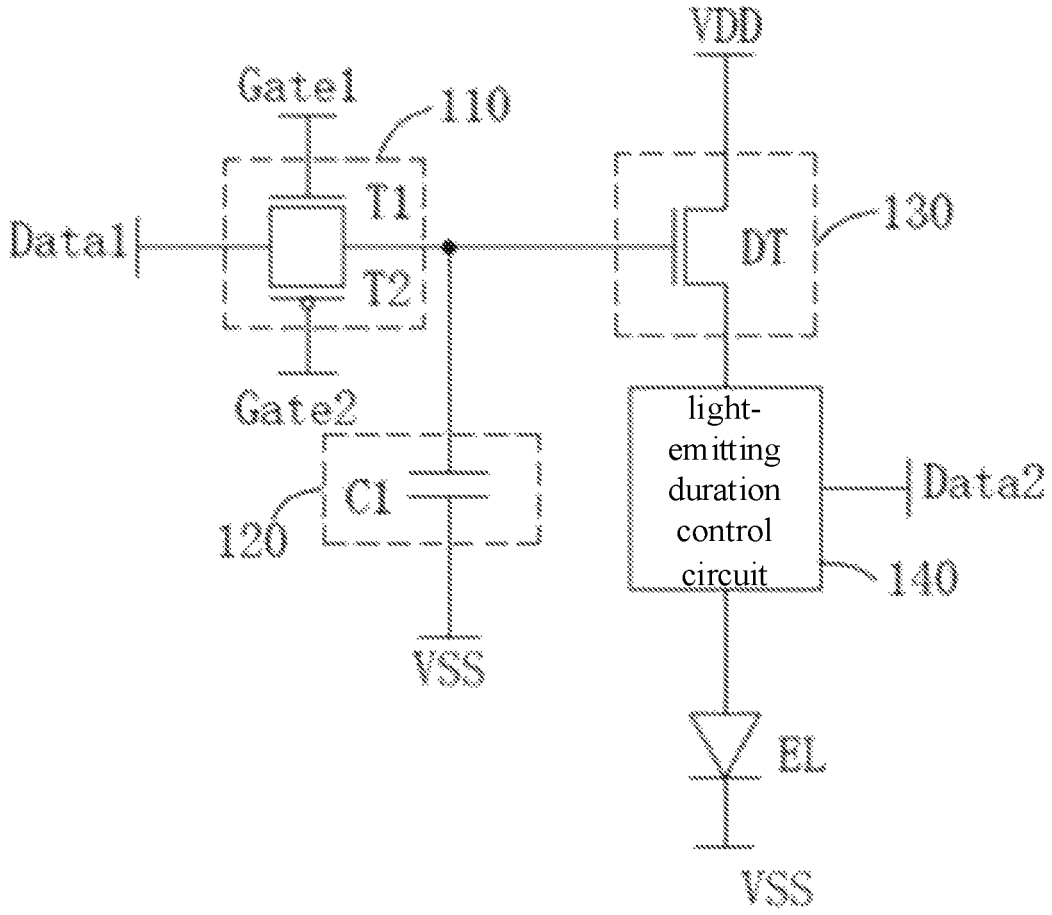
FIG. 2 is a schematic structural diagram of a pixel circuit in some embodiments of the present disclosure.

Specifically, as shown in FIG. 2, the gate line Gate may include a first gate line Gate1 and a second gate line Gate2; the data writing circuit 110 may include a first data writing transistor T1 and a second data writing transistor T2, where a control end of the first data writing transistor T1 is connected to a first gate line Gate1, a first end of the first data writing transistor T1 is connected to a first end of the storage capacitor circuit 120, and a second end of the first data writing transistor T1 is connected to a display data line; the control end of the second data writing transistor T2 is connected to the second gate line Gate2, the first end of the second data writing transistor T2 is connected to the first end of the storage capacitor circuit 120, and the second end of the second data writing transistor T2 is connected to the display data line. The first data writing transistor T1 may be a Negative channel Metal Oxide Semiconductor (NMOS), and the second data writing transistor T2 may be a Positive channel Metal Oxide Semiconductor (PMOS).

By including an NMOS transistor and a PMOS transistor in the data writing circuit 110, the data voltage range on the data line may be increased, and the light-emitting brightness of the light-emitting element may be improved.

As shown in FIG. 2, the storage capacitor circuit 120 may include a first capacitor C1, a first end of which is connected to a second end of the data writing circuit 110, and a second end of which is electrically connected to a first voltage end. The first voltage end is a voltage end with a constant voltage value, and the voltage at the second end of the first capacitor C1 remains unchanged according to the charge holding law, so that the voltage at the first end of the first capacitor C1 does not change, thereby holding the potential of the display data voltage provided by the data writing circuit 110 at the first end of the first capacitor C1.

As shown in FIG. 2, the driving circuit 130 may include a driving transistor DT, a control end of the driving transistor DT is electrically connected to a first end of the storage capacitor circuit 120, a first end of the driving transistor DT is electrically connected to a power supply voltage line, and a second end of the driving transistor DT is electrically connected to the light-emitting device via the light-emitting duration control circuit 140.

The driving transistor DT turns on or turns off the electrical connection between the first electrode of the driving transistor DT and the second electrode of the driving transistor DT in response to the potential of the first end of the first capacitor, and in the case where the electrical connection between the first electrode of the driving transistor DT and the second electrode of the driving transistor DT is turned on, a high-level signal on the supply voltage line is transmitted to the second electrode of the driving transistor DT. Here, the driving transistor DT may be an NMOS transistor.

As shown in FIG. 1, the control end of the light-emitting duration control circuit 140 is electrically connected to the duration data line, the first end of the light-emitting duration control circuit 140 is electrically connected to the second end of the driving circuit 130, and the second end of the light-emitting duration control circuit 140 is electrically connected to the light-emitting device.

The light-emitting duration control circuit 140 controls the duration in which the light-emitting device emits light based on the high-level signal by turning on or off the electrical connection between the second end of the driving circuit 130 and the light-emitting device. Specifically, the light-emitting duration control circuit 140 may turn on the electrical connection between the second end of the driving circuit 130 and the light-emitting device within a part of a display period of one frame, and may turn off the electrical connection between the second end of the driving circuit 130 and the light-emitting device within the rest part of the display period of one frame, so as to reduce the light-emitting duration of the light-emitting device.

For example, the light-emitting duration control circuit 140 may first turn on the electrical connection between the second end of the driving circuit 130 and the light-emitting device, and then turn off the electrical connection between the second end of the driving circuit 130 and the light-emitting device after the duration of continuous electrical connection reaches the duration corresponding to the desired displayed gray scale value. Alternatively, the light-emitting duration control circuit 140 may divide the display period of one frame into the N (N is a positive integer) groups of light-emitting control periods in advance, and the electrical connection between the second end of the driving circuit 130 and the light-emitting device is turned on or off within each light-emitting control period, the electrical connection between the second end of the driving circuit 130 and the light-emitting device is turned on at M ($1 \leq M \leq N$, M is a positive integer) light-emitting control periods, and the electrical connection between the second end of the driving circuit 130 and the light-emitting device is turned off at the rest of the light-emitting control periods, where the M light-emitting control periods may be M light-emitting control periods consecutive within the N light-emitting control periods, or may be dispersed M light-emitting control periods.

The light-emitting duration control circuit 140 turning on or off the electrical connection between the second end of the driving circuit 130 and the light-emitting device may be performed based on the level of the duration data line, or performed by adding a switching device between the duration data line and the control electrode of the light-emitting duration control circuit 140 and based on the turning on or off state of the switching device and the level of the duration data line.

The first electrode of the light-emitting device is electrically connected to the second end of the light-emitting duration control circuit 140, and the second electrode of the light-emitting device is electrically connected to the common ground voltage line VSS. The light-emitting device may be an OLED, the first electrode of the light-emitting device may be an anode of the OLED, and the second electrode of the light-emitting device may be a cathode of the OLED.

Figure 3:
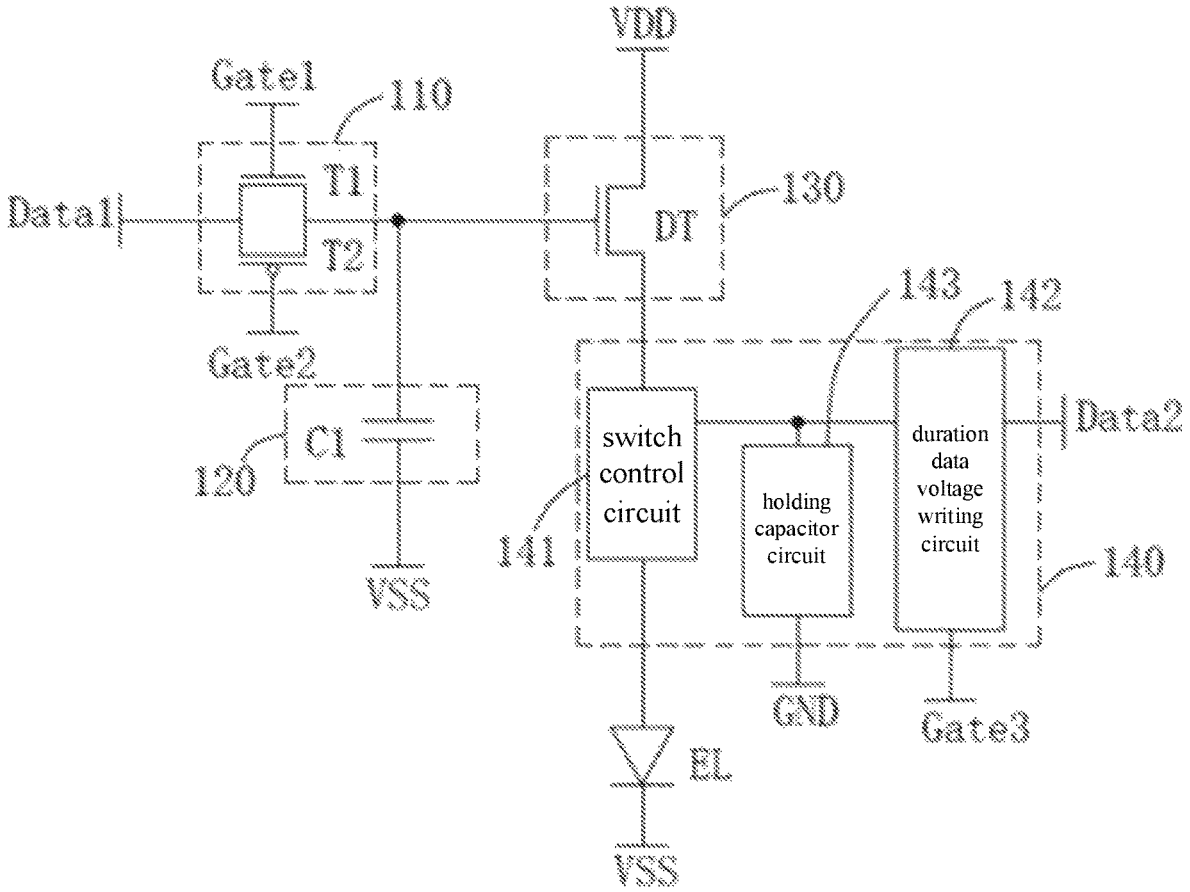
FIG. 3 is a schematic structural diagram of a pixel circuit in some embodiments of the present disclosure.

Optionally, as shown in FIG. 3, the light-emitting duration control circuit 140 includes a switch control circuit 141, a duration data voltage writing circuit 142, and a holding capacitor circuit 143.

The duration data voltage writing circuit 142 is configured to write the duration data voltage provided by the duration data line to the first end of the holding capacitor circuit 143 in response to the duration control signal provided by the duration control line;

A first end of the holding capacitor circuit 143 is electrically connected to a control end of the switch control circuit 141, and a second end of the holding capacitor circuit 143 is electrically connected to a second voltage end;

The switch control circuit 141 is configured to turn on or off the electrical connection between the second end of the driving circuit 130 and the light-emitting device EL in response to the potential of the first end of the holding capacitor circuit 143.

The control end of the duration data voltage writing circuit 142 is electrically connected to the duration control line Gate3, the first end of the duration data voltage writing circuit 142 is electrically connected to the duration data line Data2, and the second end of the duration data voltage writing circuit 142 is connected to the first end of the holding capacitor circuit 143. In response to the duration control signal provided by the duration control line Gate3, the duration data voltage writing circuit 142 writes the duration data voltage provided by the duration data line Data2 into the first end of the holding capacitor circuit 143.

The holding capacitor circuit 143 is configured to, after the duration data voltage writing circuit 142 writes the duration data voltage to the first end of the holding capacitor circuit 143, enable and hold the potential of the first end of the holding capacitor circuit 143 to be equal to the potential of the duration data voltage.

The control end of the switch control circuit 141 is electrically connected to the first end of the holding capacitor circuit 143, the first end of the switch control circuit 141 is electrically connected to the second end of the driving circuit 130, and the second end of the switch control circuit 141 is electrically connected to the light-emitting device EL.

The duration control line Gate3 may be electrically connected to the output end of the shift register, and correspondingly provides a control duration control signal according to the gray scale value of the sub-pixel display required, where the higher the gray scale value of the sub-pixel display required, the higher the duty cycle of the high level in the duration control signal will be.

Figure 4:
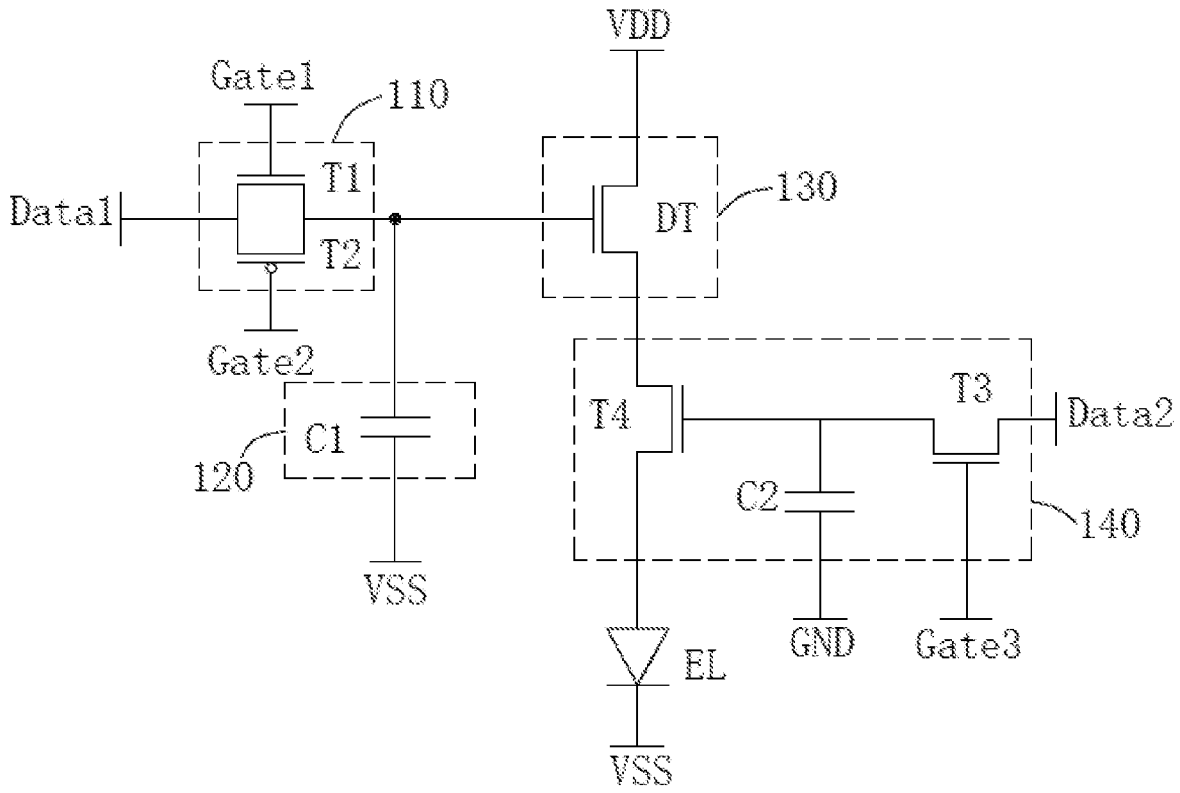
FIG. 4 is a schematic structural diagram of a pixel circuit in some embodiments of the present disclosure.

Optionally, as shown in FIG. 4, the duration data voltage writing circuit 142 includes a duration data voltage writing transistor T3.

The control end of the duration data voltage writing transistor T3 is electrically connected to the duration control line Gate3, the first end of the duration data voltage writing transistor T3 is electrically connected to the duration data line Data2, and the second end of the duration data voltage writing transistor T3 is electrically connected to the first end of the holding capacitor circuit 143.

In response to the duration control signal provided by the duration control line Gate3, the duration data voltage writing transistor T3 writes the duration data voltage on the duration data line Data2 into the first end of the holding capacitor circuit 143.

Here, the duration data voltage writing transistor T3 may be an NMOS transistor.

Alternatively, as shown in FIG. 4, the holding capacitor circuit 143 includes a second capacitor C2, a first end thereof is electrically connected to a control end of the switch control circuit 141, and a second end thereof is electrically connected to a second voltage end.

A first end of the second capacitor C2 is electrically connected to a control end of the switch control circuit 141, and a second end of the second capacitor C2 is electrically connected to the second voltage end. Here, the second voltage end is a voltage end with a constant voltage value, for example, a ground end GND. According to the charge holding law, the voltage at the second end of the second capacitor C2 remains unchanged, and the voltage at the first end of the second capacitor C2 does not change, thereby serving as a potential of a long data voltage provided by the long data voltage writing circuit 142 at the first end of the second capacitor C2.

Alternatively, as shown in FIG. 4, the switch control circuit 141 includes a switch transistor T4;

The control end of the switch transistor T4 is electrically connected to the first end of the holding capacitor circuit 143, the first end of the switch transistor T4 is electrically connected to the second end of the driving circuit 130, and the second end of the switch transistor T4 is electrically connected to the light-emitting device EL.

In response to the potential of the first end of the sustain capacitance circuit 143, the electrical connection between the first electrode of the switch transistor T4 and the second electrode of the switch transistor T4 is turned on, so that the electrical connection between the second end of the driving circuit 130 and the light-emitting device EL is turned on.

The switch transistor T4 may be an NMOS transistor.

Figure 5:
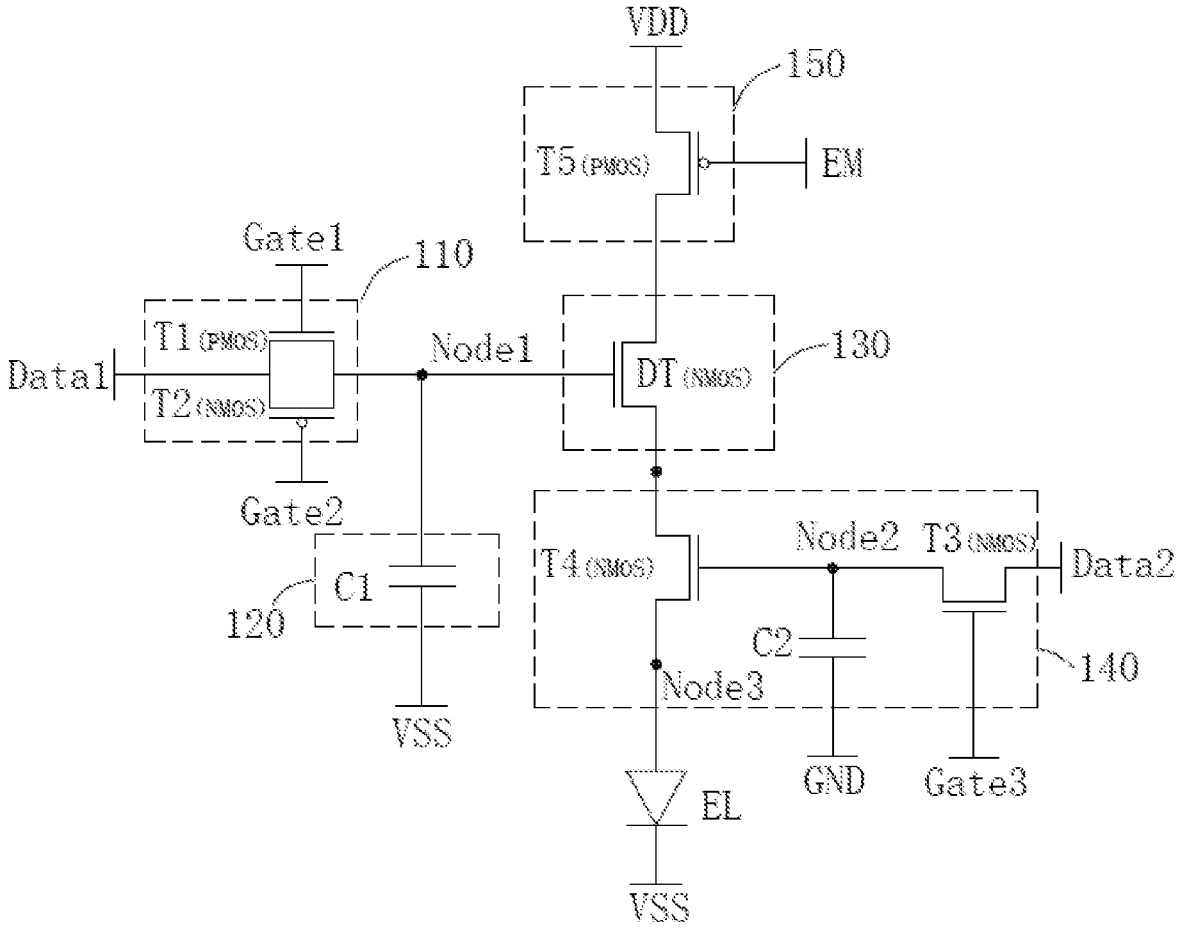
FIG. 5 is a schematic structural diagram of a pixel circuit in some embodiments of the present disclosure.

Optionally, as shown in FIG. 5, the pixel circuit further includes a light-emitting control circuit 150.

The first end of the driving circuit 130 is electrically connected to the power supply voltage line VDD via the light-emitting control circuit 150, and the light-emitting control circuit 150 is configured to turn on the electrical connection between the first end of the driving circuit 130 and the power supply voltage line VDD in response to the light-emitting control signal provided by the light-emitting control line EM.

As shown in FIG. 5, the light-emitting control circuit 150 includes a light-emitting control transistor T5, the control end of which is connected to the light-emitting control line EM, the first end of which is connected to the power supply voltage line VDD, and the second end of which is connected to the first end of the driving transistor DT. In response to the light-emitting control signal provided by the light-emitting control line EM, the first electrode of the light-emitting control transistor T5 is electrically connected to the second electrode of the light-emitting control transistor T5, thereby electrically connecting the power supply voltage line VDD to the first end of the driving circuit 130.

The light-emitting control transistor T5 may be a PMOS transistor.

Figure 6:
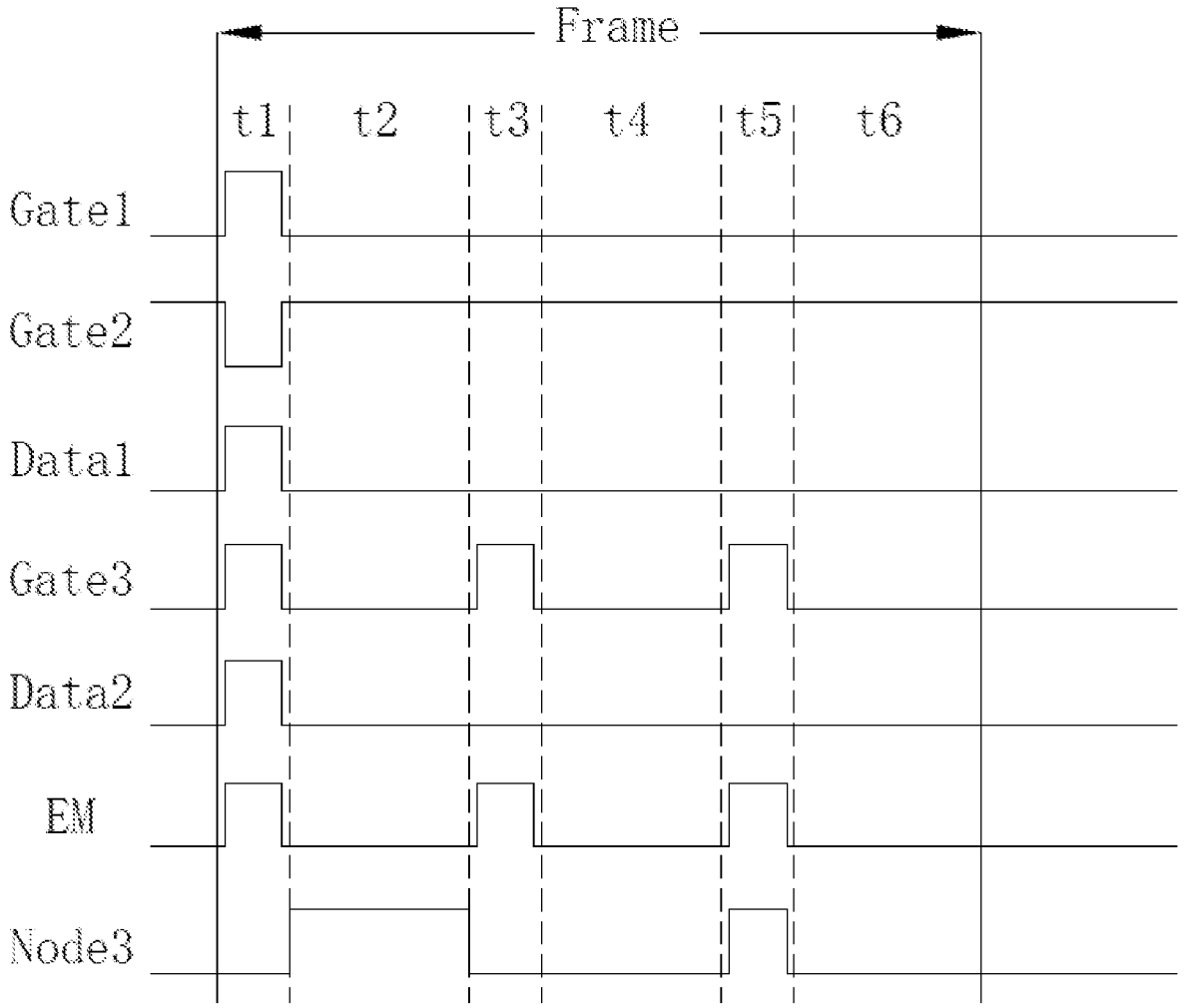
FIG. 6 is a timing diagram of signal lines in a pixel circuit in some embodiments of the present disclosure.

For the pixel circuit shown in FIG. 5, a timing chart of each signal line is shown in FIG. 6, where t1 and t2 are the first group of light-emitting control periods, t3 and t4 are the second group of light-emitting control periods, and t5 and t6 are the third group of light-emitting control periods. It should be noted that a frame display period may further include two groups of light-emitting control periods, five groups of light-emitting control periods, eight groups of light-emitting control periods, and the like, which are not limited herein.

A first set of light-emitting control periods will be described:

Stage t1 is a charge compensation stage. In stage t1, the gate scan signal on the first gate line Gate1 is at a low level to turn on the electrical connection between the first electrode of the first data writing transistor T1 and the second electrode of the first data writing transistor T1, and the gate scan signal on the second gate line Gate2 is at a high level to turn on the electrical connection between the first electrode of the second data writing transistor T2 and the second electrode of the second data writing transistor T2. At this time, the display data voltage (high level) on the display data line Data1 is written to the Node1 node. In addition, the duration control signal on the duration control line Gate3 is at a high level, so that the electrical connection between the first electrode of the duration data voltage writing transistor T3 and the second electrode of the duration data voltage writing transistor T3 is turned on, and the duration data voltage (high level) on the duration data line Data2 is written to the Node2 node.

In this case, the light-emitting control signal on the light-emitting control line EM is at a high level, the electrical connection between the first electrode of the light-emitting control transistor T5 and the second electrode of the light-emitting control transistor T5 is turned off, the Node3 node has no voltage, and the light-emitting device EL does not emit light.

The t2 phase is a pixel light-emitting phase in which the light-emitting control signal on the light-emitting control signal line EM is at a low level, and the electrical connection between the first electrode of the light-emitting control transistor T5 and the second electrode of the light-emitting control transistor T5 is turned on.

The gate scan signal on the first gate line Gate1 is at a high level, so that the electrical connection between the first electrode of the first data writing transistor T1 and the second electrode of the first data writing transistor T1 is turned off, and the gate scan signal on the second gate line Gate2 is at a low level, so that the electrical connection between the first electrode of the second data writing transistor T2 and the second electrode of the second data writing transistor T2 is turned off. At this time, the potential on the node Node1 is the display data voltage (high level) written in the phase t1. Therefore, in response to the potential of the Node1 node, the electrical connection between the first electrode of the driving transistor DT and the second electrode of the driving transistor DT is turned on.

The duration control signal on the duration control line Gate3 is at a low level, so that the electrical connection between the first electrode of the duration data voltage writing transistor T3 and the second electrode of the duration data voltage writing transistor T3 is turned off. At this time, the potential on the node Node2 is the duration data voltage (high level) written in the phase t1. Therefore, in response to the potential of the Node2 node, the electrical connection between the first electrode of the switch transistor T4 and the second electrode of the switch transistor T4 is turned on.

In this way, there is a voltage at the Node3 node, so that the light-emitting device EL may keep emitting light at the t2 stage.

A second group of light-emitting control periods is briefly described based on the description of the first group of light-emitting control periods:

Since the duration data voltage on the duration data line Data2 is a low level in the t3 period, that is, the duration data voltage written to the Node2 node in the t3 period is at a low level, and in the t4 period, in response to the potential of the Node2 node, the electrical connection between the first electrode of the switch transistor T4 and the second electrode of the switch transistor T4 is turned off, there is no voltage on the Node3 node, and the light-emitting device EL cannot emit light.

It should be noted that, in the charge compensation phase in each group of light-emitting control periods, the duration control signals on the duration control lines Gate3 are all at high levels, and the light-emitting control signals on the light-emitting control signal lines EM are also at high levels. However, the duration data voltage on the duration data line Data2 may be either at a high level or a low level, that is, within a display period of one frame, the duration control signal on the duration control line Gate3 includes at least two rising edges, and the number of rising edges of the duration data voltage on the duration data line Data2 is less than or equal to the number of rising edges of the duration control signal. Therefore, by controlling the level of the duration data voltage on the duration data line Data2, it is able to control the duration of the light-emitting device EL to emit light, thereby realizing the display of low gray scale when the display device is in the high luminance mode.

A display device including the pixel circuit described above is further provided in some embodiments of the present disclosure.

The display device may be a display, a mobile phone, a tablet computer, a television, a wearable electronic device, a navigation display device, or the like.

The embodiments of the present disclosure have been described above in conjunction with the drawings, but the present disclosure is not limited to the embodiments described above. The embodiments described above are merely illustrative and not restrictive, and those of ordinary skill in the art will be able to make many forms without departing from the principle of the disclosure and the scope of the claims, all of which fall within the scope of the present disclosure.

What is claimed is:

1. A pixel circuit, comprising: a data writing circuit, a storage capacitor circuit, a driving circuit, a light-emitting duration control circuit, and a light-emitting device, wherein the data writing circuit is configured to, in response to a gate driving signal provided by a gate line, write a display data voltage on a display data line to a control end of the driving circuit;

a first end of the storage capacitor circuit is electrically connected to a control end of the driving circuit, and a second end of the storage capacitor circuit is electrically connected to a first voltage end;

a first end of the driving circuit is electrically connected to a power supply voltage line, a second end of the driving circuit is electrically connected to the light-emitting device via the light emitting duration control circuit, and the driving circuit is configured to, in response to a potential of a control end of the driving circuit, enable the first end of the driving circuit to electrically connect to the second end of the driving circuit;

the light-emitting duration control circuit is configured to, in response to a duration data voltage provided by a duration data line, turn on or turn off an electrical connection between the second end of the driving circuit and the light-emitting device, to control a light-emitting duration of the light-emitting device, wherein the light-emitting duration control circuit comprises a switch control circuit, a duration data voltage writing circuit and a holding capacitor circuit, wherein the duration data voltage writing circuit is configured to, in response to a duration control signal provided by a duration control line, write the duration data voltage provided by the duration data line to a first end of the holding capacitor circuit;

the first end of the holding capacitor circuit is electrically connected to a control end of the switch control circuit, and a second end of the holding capacitor circuit is electrically connected to a second voltage end;

the switch control circuit is configured to, in response to a potential of the first end of the holding capacitor circuit, turn on or turn off the electrical connection between the second end of the driving circuit and the light-emitting device.

2. The pixel circuit according to claim 1, wherein the duration data voltage writing circuit comprises a duration data voltage writing transistor;

a control electrode of the duration data voltage writing transistor is electrically connected to the duration control line, a first electrode of the duration data voltage writing transistor is electrically connected to the duration data line, and a second electrode of the duration data voltage writing transistor is electrically connected to the first end of the holding capacitor circuit.

3. The pixel circuit according to claim 2, wherein the holding capacitor circuit is configured to hold the potential of the first end of the holding capacitor circuit to be equal to a potential of the duration data voltage in a case that the duration data voltage writing circuit writes the duration data voltage to the first end of the holding capacitor circuit.

4. The pixel circuit according to claim 2, wherein the duration data voltage writing transistor is an NMOS transistor.

5. The pixel circuit according to claim 1, wherein the holding capacitor circuit includes a capacitor, a first end of the capacitor is electrically connected to the control end of the switch control circuit, and a second end of the capacitor is electrically connected to the second voltage end.

6. The pixel circuit according to claim 1, wherein the switch control circuit comprises a switch transistor;

a control electrode of the switch transistor is electrically connected to the first end of the holding capacitor circuit, a first electrode of the switch transistor is electrically connected to the second end of the driving circuit, and a second electrode of the switch transistor is electrically connected to the light-emitting device.

7. The pixel circuit according to claim 6, wherein the switch transistor is an NMOS transistor.

8. The pixel circuit according to claim 1, further comprising a light-emitting control circuit, wherein the first end of the driving circuit is electrically connected to the power supply voltage line via the light-emitting control circuit, and the light-emitting control circuit is configured to, in response to a light-emitting control signal provided by a light-emitting control line, enable the first end of the driving circuit to electrically connect to the power supply voltage line.

9. The pixel circuit according to claim 8, wherein the driving circuit comprises a driving transistor, a control electrode of the driving transistor is connected to the first end of the storage capacitor circuit, a first electrode of the driving transistor is connected to a second end of the light-emitting control circuit, and a second electrode of the driving transistor is connected to a first end of the light-emitting duration control circuit.

10. The pixel circuit according to claim 9, wherein the light-emitting control circuit comprises a light-emitting control transistor, wherein a control electrode of the light-emitting control transistor is electrically connected to the light-emitting control line, a first electrode of the light-emitting control transistor is connected to the power supply voltage line, and a second electrode of the light-emitting control transistor is connected to the first electrode of the driving transistor.

11. The pixel circuit according to claim 10, wherein the light-emitting control transistor is a PMOS transistor.

12. The pixel circuit according to claim 1, wherein the gate line comprises a first gate line and a second gate line;

the data writing circuit comprises a first data writing transistor and a second data writing transistor;

a gate of the first data writing transistor is connected to the first gate line, a source of the first data writing transistor is connected to the data line, and a drain of the first data writing transistor is connected to the first end of the storage capacitor circuit;

a gate of the second data writing transistor is connected to the second gate line, a drain of the second data writing transistor is connected to the data line, and a source of the second data writing transistor is connected to the first end of the storage capacitor circuit;

the first data writing transistor is a type-P transistor, and the second data writing transistor is a type-N transistor.

13. The pixel circuit according to claim 1, wherein the light-emitting device is an organic light-emitting device.

14. A display device comprising the pixel circuit according to claim 1.

15. A pixel circuit, comprising: a data writing circuit, a storage capacitor circuit, a driving circuit, a light-emitting duration control circuit, a light-emitting device, and a light-emitting control circuit, wherein the data writing circuit is configured to, in response to a gate driving signal provided by a gate line, write a display data voltage on a display data line to a control end of the driving circuit;

a first end of the storage capacitor circuit is electrically connected to a control end of the driving circuit, and a second end of the storage capacitor circuit is electrically connected to a first voltage end;

a first end of the driving circuit is electrically connected to a power supply voltage line, a second end of the driving circuit is electrically connected to the light-emitting device via the light emitting duration control circuit, and the driving circuit is configured to, in response to a potential of a control end of the driving circuit, enable the first end of the driving circuit to electrically connect to the second end of the driving circuit;

the light-emitting duration control circuit is configured to, in response to a duration data voltage provided by a duration data line, turn on or turn off an electrical connection between the second end of the driving circuit and the light-emitting device, to control a light-emitting duration of the light-emitting device, the first end of the driving circuit is electrically connected to the power supply voltage line via the light-emitting control circuit, and the light-emitting control circuit is configured to, in response to a light-emitting control signal provided by a light-emitting control line, enable the first end of the driving circuit to electrically connect to the power supply voltage line.

* * * * *